US005899312A

United States Patent [19]

Wild

[11] Patent Number: 5,899,312

[45] Date of Patent: May 4, 1999

[54] ANTI-FRAUD STRING GRABBING DEVICE

[75] Inventor: Ronald Lee Wild, Hamilton County, Ind.

[73] Assignee: Lucent Technologies Inc, Murray Hill, N.J.

[21] Appl. No.: 08/898,142

[22] Filed: Jul. 22, 1997

[51] Int. Cl.[6] ..... G07F 1/04

[52] U.S. Cl. ..... 194/203

[58] Field of Search ..... 194/203, 349; 379/145

[56] References Cited

U.S. PATENT DOCUMENTS

| | | | |
|---|---|---|---|
| 1,818,568 | 8/1931 | Melick | 194/203 |
| 2,932,374 | 4/1960 | Nicolaus | 194/203 |
| 4,128,157 | 12/1978 | Henville | 194/203 |
| 5,088,587 | 2/1992 | Goodrich et al. | 194/345 |

*Primary Examiner*—F. J. Bartuska

[57] ABSTRACT

A coin telephone instrument having a serpentine coin path is provided with string grabbers positioned at cusps in the coin path to engage the string of a tethered coin deposited by a fraudulent user. Each string grabber assembly is comprised of a pair of facing and arcuately converging lip surfaces which guide the string toward the surfaces' initial point of convergence. The grabbers, working in tandem, will stop the tethered coin during its descent before it reaches the escrow hopper, trap door and coin steering vane, thereby frustrating the fraudulent attempt. If the fraudulent user pulls back on the string to retrieve the tethered coin, the converging lip surfaces engage the string forcing it past the initial point of convergence and into the path of a sheet metal slit cutter which severs the string tether.

8 Claims, 2 Drawing Sheets

ANTI-FRAUD STRING GRABBING DEVICE

FIELD OF THE INVENTION

This invention relates to coin fraud countermeasures and, more particularly, to the capture and/or destruction of instruments used to perpetrate coin fraud.

BACKGROUND OF THE INVENTION

A species of coin fraud has arisen in which the miscreant drills a hole through a coin of the type accepted by a coin-operated device, such as a coin telephone instrument, and attaches a flexible cord or string, such as monofilament fishing line, to the coin by threading the string through the drilled hole and knotting the end to tether the coin. The coin is then deposited in the coin slot, the tethered string allowing it to fall through the coin chute of the coin telephone instrument where it triggers the deposited coin registration switch if it is recognized as a genuine coin, or is rejected to the coin return bucket if determined to be counterfeit. If the coin is recognized as valid, the coin will be held in the escrow hopper where it is stopped by a trap door until a call is placed and has been answered. The fraudulent user, however, hangs up before answer is received. In response to hangup, the telephone instrument then activates a coin return operation. The trap door opens in sequence just after a coin steering vane moves to the coin refund position. The fraudulent user allows the coin to pass through the trap door, but suspends it just below the trap door. This allows the trap door to close but the suspended coin keeps the telephone instrument's coin steering vane biased to allow coins to enter the coin return chute. The closing of the trap door allows the telephone instrument to be reset for a new call, which the fraudulent user now places. However, because the suspended coin has fouled the apparatus, all deposited coins will be returned to the miscreant at the end of the call. It would be extremely advantageous to be able to frustrate such fraudulent usage.

SUMMARY OF THE INVENTION

In accordance with the principles of the illustrative embodiment, a pair of grabber assemblies is positioned at two of the cusps of the serpentine coin path. Each grabber assembly has a pair of facing and arcuately converging lip surfaces. As the coin tumbles down the coin chute the string tethered to the coin rides against the lip surfaces of the first of the grabber assemblies, gradually being guided away from the point of widest separation of the lip surfaces toward the point where the lip surfaces converge. However, the weight of the coin is usually sufficient to carry the string past the first grabber assembly so the coin continues to fall down the coin path until is just passes the second of the pair of grabber assemblies. At this point the friction of the tether against the lip surfaces is sufficient to stop further descent of the coin so that it will not drop below the trap door thereby preventing the fraudulent user from further interfering with the operation of the telephone instrument. Should the fraudulent user now attempt to retrieve the tethered coin by pulling back on the string, the string will become snagged in a sharp metallic sheet metal slit sandwiched between each pair of lip surfaces, thereby severing the string. Advantageously, at their widest point of separation, the guiding lip surfaces extend to cover substantially the entire surface of the coin path so that wherever the string is carried by the falling coin it will be engaged by the converging lip surfaces. The guiding surfaces of the lips are advantageously fabricated of an elastomeric, rubber-like material affording sufficient surface frictional characteristics to stop the string when it has reached the second of the grabbers. The grabber lips are advantageously backed by a reinforcing leaf spring or batten to afford sufficient strength without sacrificing flexibility.

DESCRIPTION OF THE DRAWING

The foregoing and other features of the illustrative embodiment may become more apparent from a reading of the ensuing description, in which.

GENERAL DESCRIPTION

Figure 1:
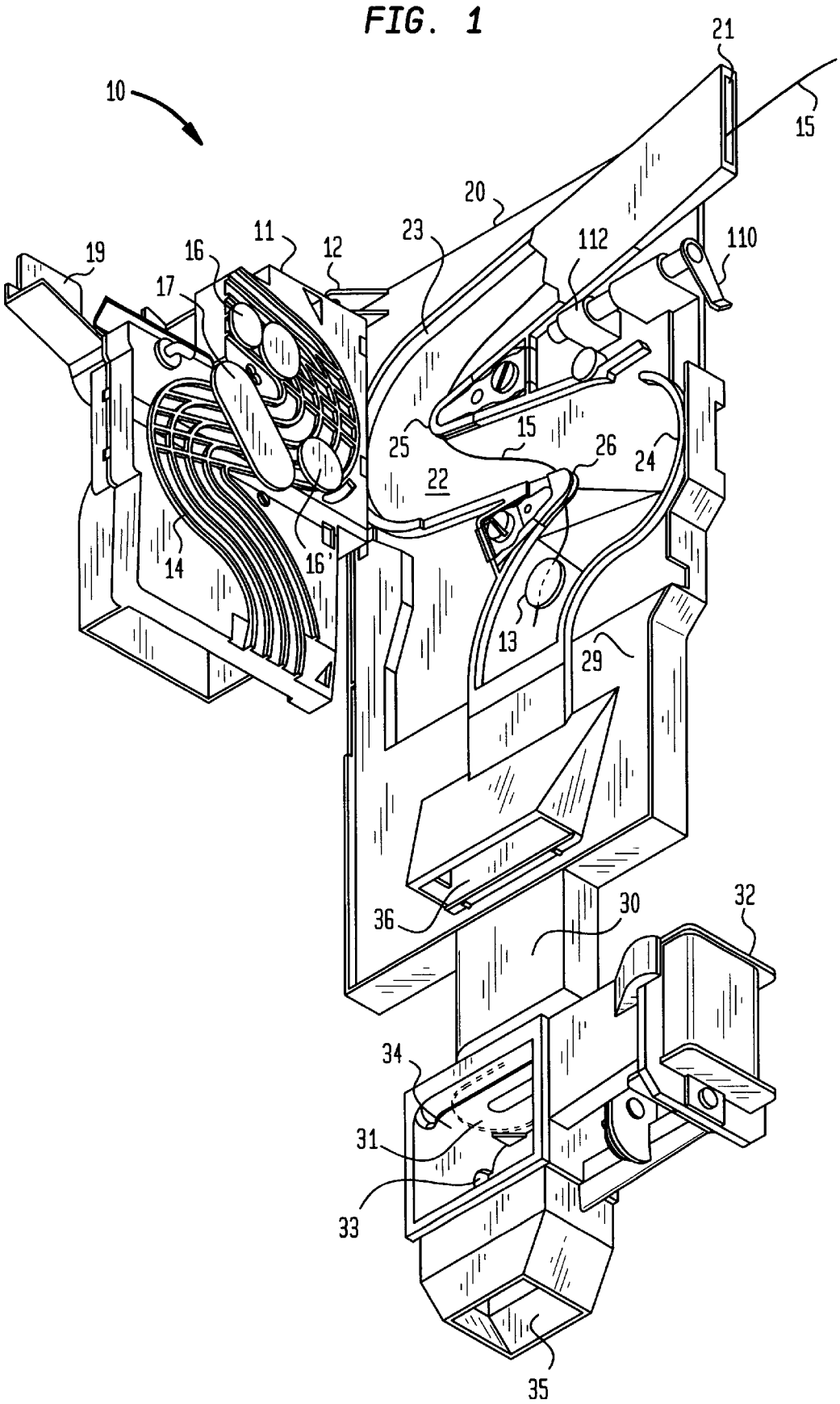
FIG. 1 shows the serpentine coin path of a prior art coin telephone instrument in which the illustrative string grabbers of the invention have been installed.

FIG. 1 shows an isometric view of a coin chute apparatus 10 of a coin telephone set of the type illustrated in U.S. Pat. No. 5,088,587. Coin chute apparatus 10 has a main body 20 and a front door 11 hinged at 12 shown in its swung open position. Main body 20 contains a coin slot 21 into which a coin 13 may be deposited. When deposited in coin slot 21, the coin falls by gravity down a serpentine coin chute path 22 defined by walls 23 and 24 in the main body 20. Articulated cusps 25 and 26 project from walls 23 and 24 respectively. Each of cusps 25 and 26 causes the coin to drop vertically in its travel down path 22. At the lower end of path 22, a coin escrow hopper 30 retains the coin above a trap door 31 pending collection or return to the customer in the event the customer hangs up before the call is answered. In the event the coin is to be collected, trap door 31 opens and solenoid 32 is energized with one polarity of current to actuate vane 33 to direct the coin toward coin collection hopper 35. In the event the coin is to be returned to the customer, solenoid 32 is energized with the opposite polarity current to allow the coin to fall through opening 34 to the coin return hopper.

The inside surface of door 11 which faces coin path 22 when door 11 is swung to its closed position contains a serpentine plastic frame guide 15 which aligns with serpentine coin chute 22 of main body 20. Mounted on plastic frame guide 15 are a number of coin validation sensors 16, 16' and 17 which perform their usual functions of ascertaining whether the coins falling through chute 22 are counterfeit or genuine. If sensors detect a counterfeit coin a door (not shown) beneath cover 29 causes the coin to fall through opening 36 to the coin return hopper. As described in the aforementioned patent, lever 110 can be operated to release a coin 13 that may have become stuck in track 22. When door 11 is swung to its closed position, a gap will exist between plastic frame guide 15 and the front surface of walls 23 and 24. The actuation of lever 110 by means of roller 112 pushes against door 11 to open the door slightly, thereby increasing the aforementioned gap enough to allow the coin to be released.

When a fraudulent user deposits a tethered coin 13 in the coin slot 21, the deposited coin 13 drops downwardly along serpentine path 22 of the coin chute, carrying along behind its tether 15. In the absence of the string grabbers of the present invention, the coin 13 would drop past cusp 25 and cusp 26 until it enters the coin escrow region 30 and rests on the trap 31 of the coin telephone, at which point the fraudulent user holds the string 15 to suspend coin 13 just below the trap 31 when it opens so as to interfere with the coin collection operation of the apparatus.

Figure 2:
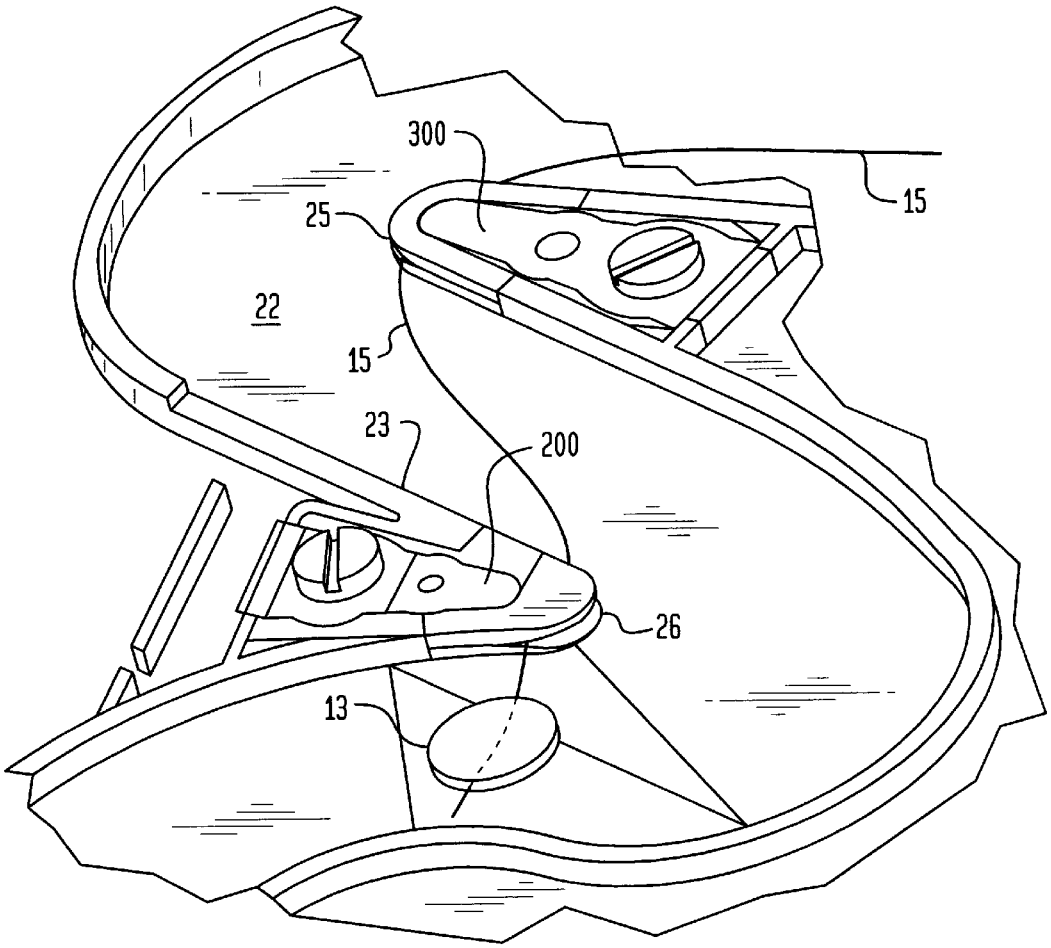
FIG. 2 is an enlarged view of the cusps of the coin path in which the illustrative string grabbers has been installed.

Referring now to FIG. 2, an enlarged view of serpentine coin path 22 in the region of upper cusp 25 and lower cusp 26 is shown. An illustrative embodiment of a string grabber 200 has been installed at lower cusp 26 and a comparable string grabber 300 has been installed at upper cusp 25. As the deposited coin 13 falls, string tether 15 is first constrained to ride between the facing lips of grabber 300 and then, if coin 13 continues to fall, string 15 is constrained to ride between the counterpart facing lips 201, 202 (shown in detail in FIG. 3) of grabber 200. As mentioned above, the weight of coin 13 may be sufficient to allow it to fall past upper string grabber 300 installed at cusp 25. However, the string will be slowed somewhat by the friction of its rubbing against the lips of grabber 300. By the time coin 13 passes grabber 200, however, sufficient frictional engagement of string 15 by grabbers 300 and 200 has occurred to stop the fall of coin 13, thereby preventing it from entering the coin escrow compartment 30 (FIG. 1) and/or passing through trap door 31. Should the miscreant pull back on string 15, as explained in connection with FIG. 3, it will be forced into more intimate contact with the lips of grabbers 300 and 300 where it may ultimately be severed.

Figure 3:
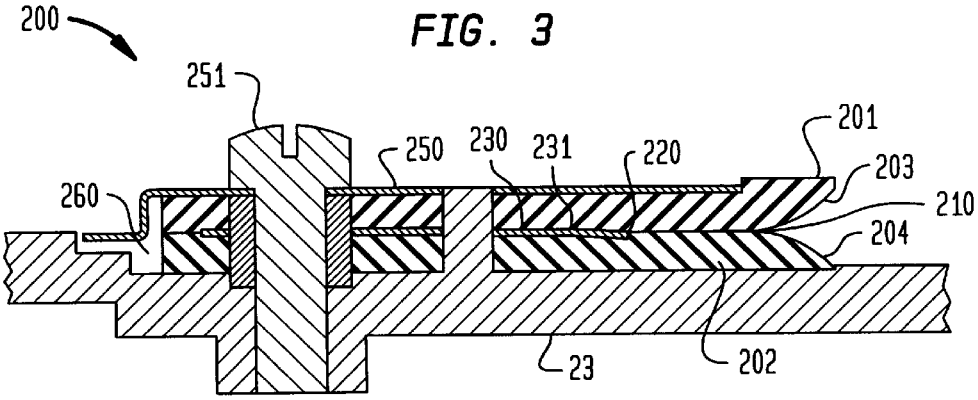
FIG. 3 is an edge view of one of the illustrative string grabbers.

FIG. 3 shows a detailed sectional view of grabber 200 mounted into a recess 260 of cusp 26. Screw 251 is threaded into cusp 26 passing, in succession, first through clearance holes in leaf spring 250, lip 202, slit cutter 230 and lip 202. Lips 201, 202 are advantageously fabricated of flexible, elastomeric material. The arcuate surfaces 203, 204 at the ends of lips 201, 202 taper to a point of contact 210 and are adapted to frictionally engage string 15. At their point of widest separation surfaces 203, 204 extend substantially to the depth d of coin path 22 when door 11 is closed. This constrains both coin 13 and its tether 15 to ride between surfaces 203, 204. Initially, string 15 slidingly and frictionally contacts one or the other of surfaces 203, 204 and is guided to the point of contact 210. Once the downward dropping of coin 13 has been arrested by the frictional engagement of its tether 15 by grabbers 200, 300 any attempt by the fraudulent user to pull back on string 15 will cause the string to be drawn past initial point 210 toward point 220 thereby causing lips 201, 202 to separate slightly under the tension of the pull on string 15. At point 220, string 15 is caught in the slit 231 of sheet metal slit cutter 230 which snags and cuts the string.

What has been described is deemed to be illustrative of the principles of the invention. It should be understood that suitable rubberlike materials may be employed in fabricating lips 201, 202 including various elastomers. Further and other modifications will be apparent to those skilled in the art without however departing from the spirit and scope of the invention.

What is claimed is:

1. An anti-fraud device for a coin telephone instrument having a serpentine coin path including one or more cusps, comprising, in combination:

a pair of opposed, flexible grabber lips positioned at at least one of said cusps of said coin path, said lips having facing arcuate surfaces converging together at a point of contact and extending at their farthest apart point to the depth of said coin path; and a sheet metal strip having a sharp slit interposed between said flexible grabber lips, said arcuate surfaces being adapted to guide toward said slit the string of a tethered coin falling through said coin path.

2. An anti-fraud device according to claim 1 wherein each cusp of said serpentine coin path is provided with the combination set forth in claim 1.

3. An anti-fraud device according to claim 2 wherein said flexible grabber lips are adapted to tension said string between them when said coin falls through said coin path trailing said string.

4. An anti-fraud device according to claim 3 wherein said cusps are provided with a recess to accommodate at least a portion of one of said pair of flexible grabber lips.

5. An anti-fraud device according to claim 4 wherein said flexible grabber lips are adapted to be spread apart by said string when pulled in said opposite direction.

6. An anti-fraud device for defeating the operation of a tethered coin deposited into the serpentine coin path of a coin telephone instrument which coin path includes at least a pair of cusps each of which causes a deposited coin to drop freely for some vertical distance within said path, comprising, in combination:

a pair of leaf spring backed grabber lips installed at each said cusp for frictionally engaging a tether attached to said coin as said coin drops past said cusp, said lips having arcuate surfaces of elastomeric material extending throughout the depth of said coin path.

7. An anti-fraud device according to claim 6 wherein said having arcuate surfaces converge at a point.

8. An anti-fraud device for defeating the operation of a tethered coin deposited into a coin telephone instrument having a serpentine coin path which includes at least a pair of cusps each of which causes a deposited coin to drop freely for some vertical distance within said path, comprising in combination:

a pair of leaf spring backed grabber lips installed at each said cusp for frictionally engaging between a pair of said cusps a tether attached to said coin as said coin drops, said lips having arcuate surfaces of elastomeric material which converge at a point, wherein said lips embrace between them a sheet metal plate having a sharpened slit adjacent to said point at which said surfaces converge.

* * * * *